United States Patent [19]

Tucker

[11] Patent Number: 4,964,639

[45] Date of Patent: Oct. 23, 1990

[54] GOLF PUTTER

[75] Inventor: Richard B. C. Tucker, Baltimore, Md.

[73] Assignee: Wm. T. Burnett & Co., Inc., Baltimore, Md.

[21] Appl. No.: 578,421

[22] Filed: Feb. 9, 1984

Related U.S. Application Data

[63] Continuation of Ser. No. 186,334, Sep. 11, 1980, abandoned, which is a continuation-in-part of Ser. No. 22,031, Mar. 19, 1979, abandoned, which is a continuation-in-part of Ser. No. 920,062, Jun. 28, 1978, abandoned.

[51] Int. Cl.[5] ..... A63B 53/04; A63B 69/36

[52] U.S. Cl. ..... 273/164; 273/78; 273/169; 273/77 R; 273/167 A; 273/167 G; 273/173

[58] Field of Search ..... 273/169, 167 R, 167 A, 273/167 B, 167 C, 167 E, 77 R, 77 A, 80.2–80.9, 164, 80 C, 78, 167 G, 173

[56] References Cited

U.S. PATENT DOCUMENTS

| | | | |
|---|---|---|---|
| D. 209,301 | 11/1967 | Comitz | 273/167 G |
| 687,540 | 11/1901 | Palmer | 273/80.2 |
| 3,085,804 | 4/1963 | Pieper | 273/164 |
| 3,211,455 | 10/1965 | Hyden | 273/78 |
| 3,819,180 | 6/1974 | Murphy | 273/167 E X |
| 3,937,474 | 2/1976 | Jepson et al. | 273/78 X |
| 4,147,357 | 4/1979 | Strop | 273/164 |

FOREIGN PATENT DOCUMENTS

| | | | |
|---|---|---|---|
| 7550 | of 1900 | United Kingdom | 273/167 B |
| 1209466 | 10/1970 | United Kingdom | 273/80 C |

*Primary Examiner*—George J. Marlo
*Attorney, Agent, or Firm*—A. W. Breiner

[57] ABSTRACT

A golf putter is disclosed for use with a stance wherein the natural body movement of the golfer is utilized in stroking or swinging the putter, eliminating the necessity of swinging the putter around the body while trying to keep the face of the putter moving in a straight line. The head of the putter includes a face having a width greater than its height, with the base of the face having a contour substantially across the width of the face. The shaft is positioned in the head at an angle to a vertical line extending through the center of a horizontal line extending across the face of the putter. The top of the putter provides a mask so that when the shaft of the putter is held in a substantially vertical position the putter, when viewed from the top, has the appearance of having a low point on the base of the face substantially in line with the shaft. In one method of use the shaft of the putter is gripped at about mid-length or lower by a single hand of the user so that the free end of the shaft extends up the forearm of the gripping hand, preferably to about the inner elbow. The opposite free arm and hand are extended across the golfer's body, and the putter shaft and/or the putter shaft and the wrist of the gripping hand are simultaneously engaged to provide a steadying action on the putter while permitting free movement of the wrist. A normal arm-swinging motion, as in bowling, is employed in swinging the putter, providing an accurate swing.

10 Claims, 4 Drawing Sheets

FIG. 12
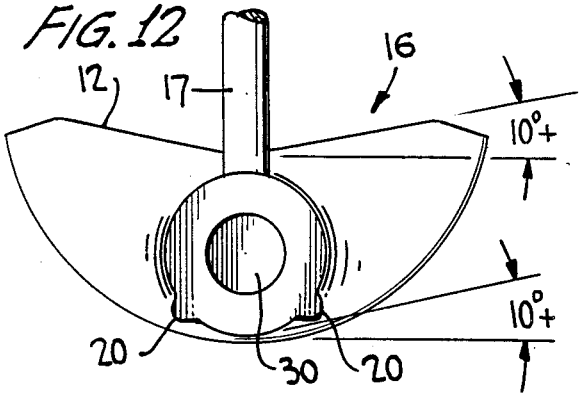
FIG. 13
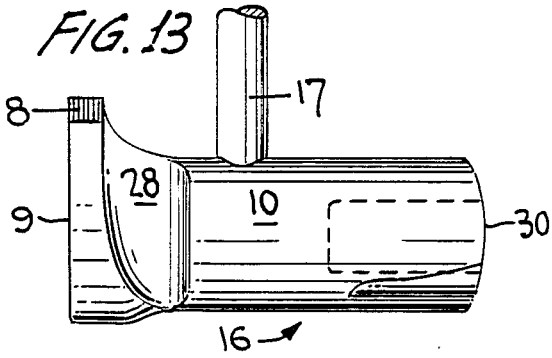
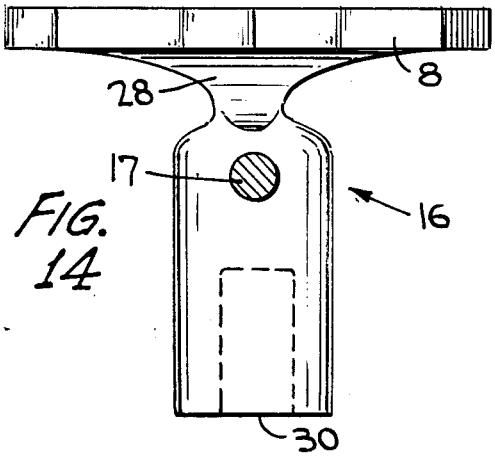
FIG. 14
FIG. 15
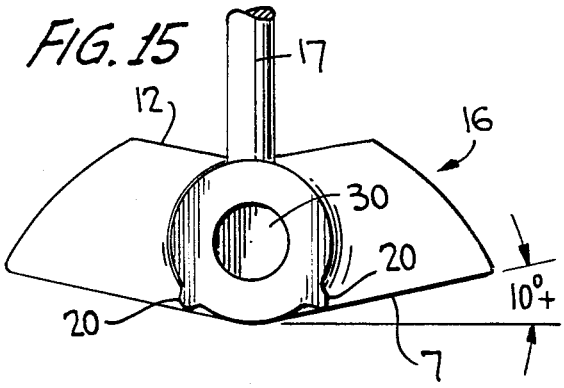
FIG. 16
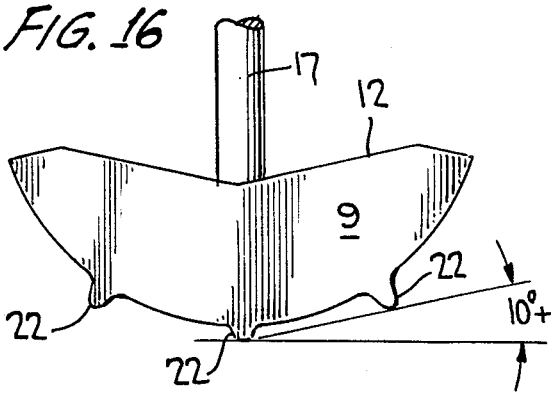
FIG. 17
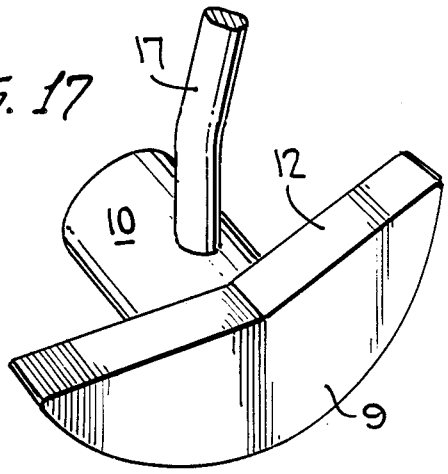
FIG. 18
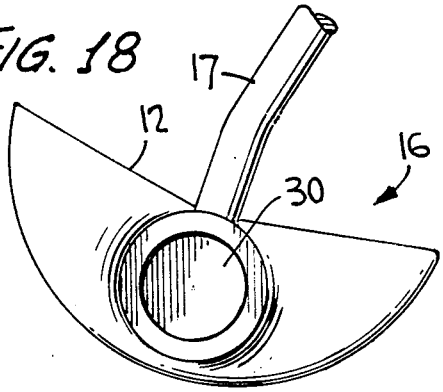
FIG. 19
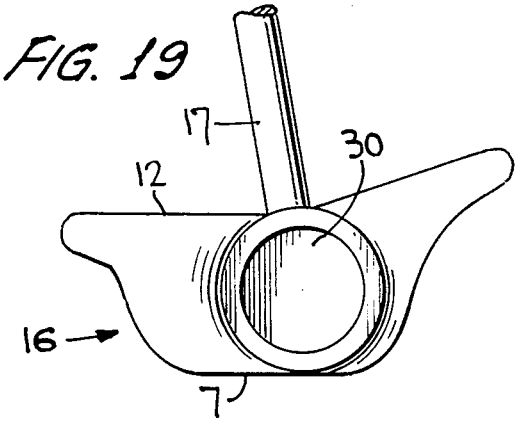

GOLF PUTTER

This is a continuation of application Ser. No. 06/186,334 filed Sept. 11, 1980, now abandoned, which application is a continuation-in-part of Ser. No. 022,031 filed Mar. 19, 1979, now abandoned; which in turn is a continuation-in-part of Ser. No. 920,062 filed June 28, 1978, now abandoned.

This invention relates in general to new and useful improvements in golf putters, and more particularly to golf putters which permit the natural body movement of the golfer to be utilized in stroking or swinging the putter, eliminating the necessity of swinging the putter around the body while trying to keep the face of the putter moving in a straight line. The body can be used as a stabilizing and/or guiding means and/or as a fixed pivot.

In the customary use of a golf club, such as a driver or an iron, the club is gripped and swung so as to attain maximum power and impact on the ball. Thus, the club is normally gripped with the hands together and swung with both arms extended across the body from side to side. Such an arrangement detracts from the accuracy of a natural swing. Notwithstanding the fact that in putting power is not required, the same or similar (hands together) grip is normally utilized and the difficulties encountered by an inaccurate swing are retained. Additional problems are introduced in putting since, in putting, a straight line should be drawn back from the ball and then forward through the ball toward the hole. The fact that both arms pivot around the body makes drawing such a straight line difficult due to the nature and characteristics of the human body. Moreover, the fact that the weight of the club head is at the end of a shaft away from the hands makes control of direction and speed difficult. With a conventional stance wherein the golfer is standing sideways, it is difficult and virtually impossible for some to establish and maintain an accurate alignment of the ball and the cup with one's eye before the swing.

It has been found that the natural body movement can be utilized in putting by gripping the putter shaft with one hand only at about the midpoint of the shaft and engaging the free end of the shaft with a portion or part of the body and utilizing the body as a stabilizing and/or guiding and/or pivot point. This permits more accurate control of the movement of the club in direction and speed. Thus, this invention provides a putter whereby the free end of the shaft can be mounted in one's armpit or the area thereof, and the arm extended full-length, or substantially full-length, alongside the putter shaft. The putter shaft is grasped with the hand of the arm at an intermediate portion of the shaft. The free hand preferably is placed on one's opposite knee to provide greater stability, leading to greater accuracy.

Alternatively, rather than mounting the free end of the shaft of the putter in one's armpit or the area thereof, the shaft of the putter is grasped with one hand at an intermediate portion of the shaft and the free end of the shaft extended along and in engagement with the forearm of the gripping hand, preferably to about the vicinity of the inner elbow. The free hand is extended across the golfer's body and used to simultaneously grip the putter shaft and the forearm.

In a preferred modification to the latter-described method, rather than simultaneously gripping the forearm and the free end of the putter shaft with the free hand, the free hand is used to engage the gripping hand at approximately the wrist between the thumb and fingers, with the free end of the shaft in loose contact within the hand and inner arm permitting free movement of the wrist. The stroke of the putter is accurately controlled both as to direction and force of contact.

As still another preferred modification in the latter method, the free end of the shaft can be loosely gripped with the free hand, again permitting free movement of the wrist of the shaft-gripping hand. The putter is guided and stabilized during the swing, providing accurate control of direction and force of contact between the ball and putter.

With the various methods above described, not only is the putter stabilized when it is moved in a normal swinging movement of the arm-similar to bowling, but it permits the player's head to maintain an alignment with the ball and the cup along the line of swing of the club, preferably with the player facing the target, thus providing for an extremely accurate swinging or stroking of the putter. The fact that the hand is moved down the shaft toward the head of the putter gives much greater feel and control. The freedom of movement of the wrist permits accuracy both as to distance and direction.

The putter provided by the present invention comprises the conventional shaft and head. However, the head includes a face having a width greater than its height, the base of the face having a contour, preferably a curvature, from one side of the face to the other. Additionally, the shaft is positioned in the head at an angle to a vertical line passing through the center of a horizontal line extending across the face of the putter. The top of the face of the putter forms a mask so that when the shaft is in a substantially vertical position the head has the appearance, when viewed from the top of the putter, of having a low point of the base of the face substantially in line with the shaft.

Accordingly, when the putter is positioned for putting by grasping the shaft of the putter at about mid-length or thereabouts with a single hand, the free end of the shaft extending up the forearm of the gripping hand, the golfer sees the head of the putter as though the lowermost point, or a lowermost point, on the face of the putter is substantially in line with the shaft, whether or not the lowermost point, or a lowermost point, is directly below the shaft or is spaced to one side or the other. The golfer, therefore, is not detracted as to where the actual lowermost point of the face of the putter is, giving the golfer confidence in making a natural swinging or stroking arm movement substantially the same as in bowling.

The novel putter will be described in the context of the illustrative drawing. In the drawing, where like parts are referred to by like numerals, FIG. 1 is a perspective view from the rear of one preferred embodiment of the putter in accordance with this invention, intermediate portions of the shaft of the putter being broken-away;

FIG. 12 is a rear elevational view of still another embodiment of the putter in accordance with this invention, the upper portion of the shaft being broken-away;

FIG. 13 is a side elevational view of the putter of FIG. 12;

FIG. 14 is a top plan view of the putter of FIG. 12;

FIG. 15 is a rear elevational view of another modified form of a putter in accordance with this invention, the upper portion of the shaft of the putter being broken-away;

FIG. 16 is a front elevational view of still another modified form of the putter in accordance with this invention, the upper portion of the shaft of the putter being broken-away;

FIG. 17 is a side perspective view of still another form of putter in accordance with this invention, with the upper portion of the shaft being broken-away;

FIG. 18 is a rear elevational view of the putter of FIG. 17 with the upper portion of the shaft being broken-away;

FIG. 19 is a rear elevational view of another modified form of putter in accordance with this invention, the upper portion of the shaft being broken-away;

Figure 1:
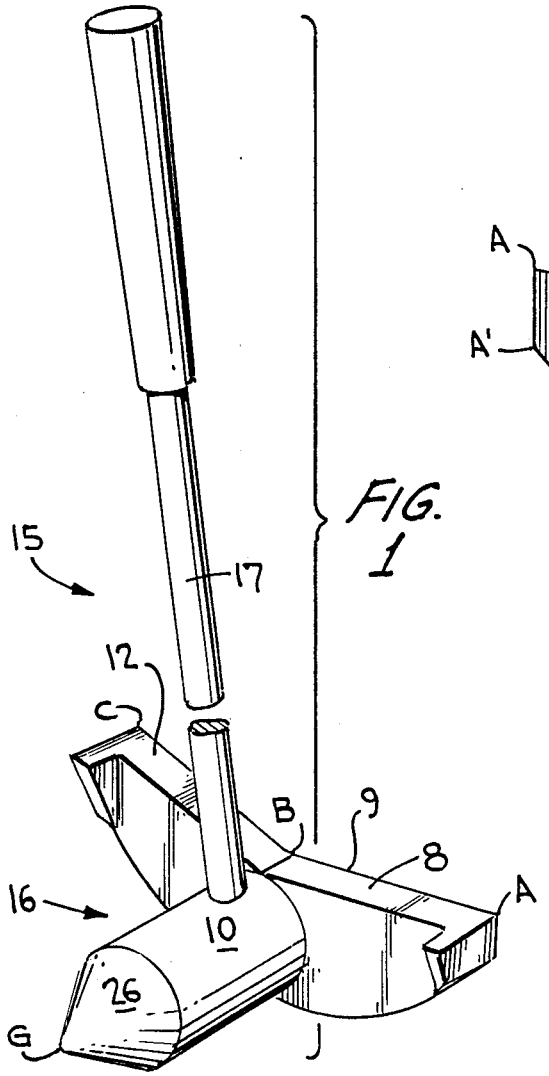
Figure 2:
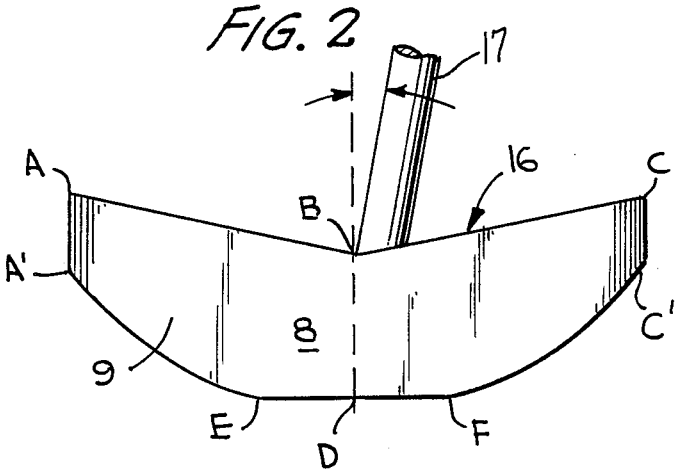
FIG. 2 is a front view of the putter of FIG. 1 with the shaft broken-away.
Figure 3:
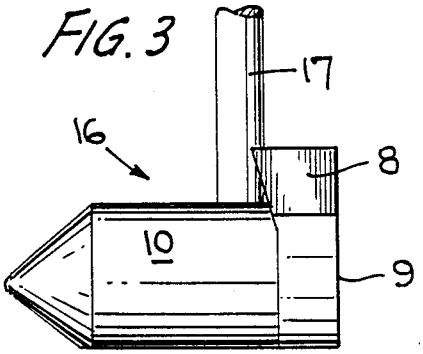
FIG. 3 is a side view of the putter of FIG. 1 with the shaft broken-away.

Reference is first made to FIGS. 1–3 which illustrate one preferred embodiment of a putter constructed in accordance with this invention. The putter is generally identified by the numeral 15 which includes a head generally identified by numeral 16 and a shaft 17 extending upwardly from the head 16.

Head 16 includes a blade-like front portion 8 which defines a striking face 9. The striking face 9 has a width AC and a height BD. Width AC is substantially greater than height BD. The face includes a contoured base 7 (A'DC') having a flat surface EF and curvatures A'E and C'F. Head 16 has a rearwardly extending body 10 to provide a substantially T-shaped putter, distance BG being substantially shorter than the width AC.

As best shown in FIGS. 1 and 2, shaft 17 extends upwardly from the top of the rearwardly extending head portion 10 at an angle of at least 10 degrees in relation to the flat portion EF at the base of the putter and at an angle to a vertical line extending through BD. The upper surface 12 of face 9 of putter 15 is concave extending from AB to BC to provide the symmetrical top surface 12. Accordingly, when the shaft of the putter is substantially vertical, the putter has the appearance, when viewed from top 12, of having a lowermost point on the base of the face of the putter substantially in line with the shaft, irrespective of the position of the lowermost point. When putter 15 is held as shown in any of FIGS. 5–8, which will be defined more fully hereinafter, the golfer holding the putter, seeing the top of the face, is given the impression that the putter is well-balanced and that the lowermost point of the putter is directly below the shaft.

Figure 4:
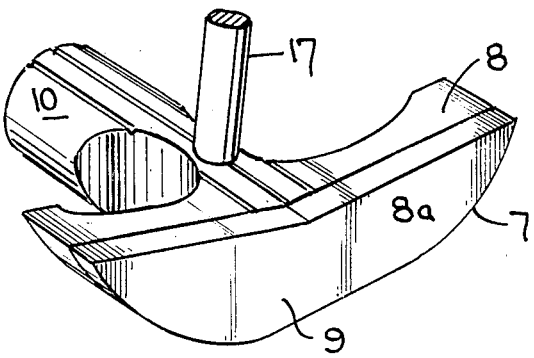
FIG. 4 is a modification of the putter of FIG. 1 and includes a face portion having controlled resiliency.
Figure 6:
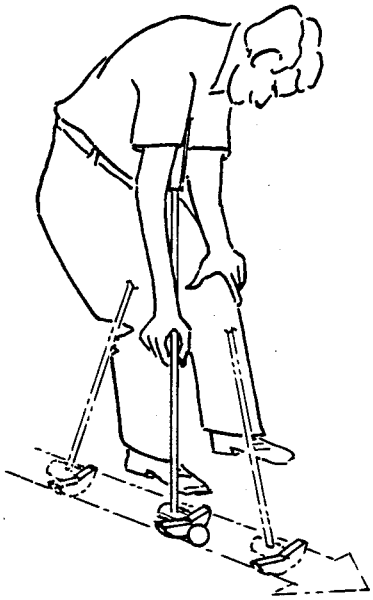
FIG. 6 is a schematic perspective view showing another preferred method of utilizing the putter of FIG. 1.

FIG. 4 is a modified version of the putter of FIG. 1 and includes a pad 8*a* on face 8. This pad, preferably being a polymeric elastomer, provides controlled resiliency, i.e., a limited shock absorbency; giving excellent feel and stroke when the putter face meets a golf ball.

Figure 9:
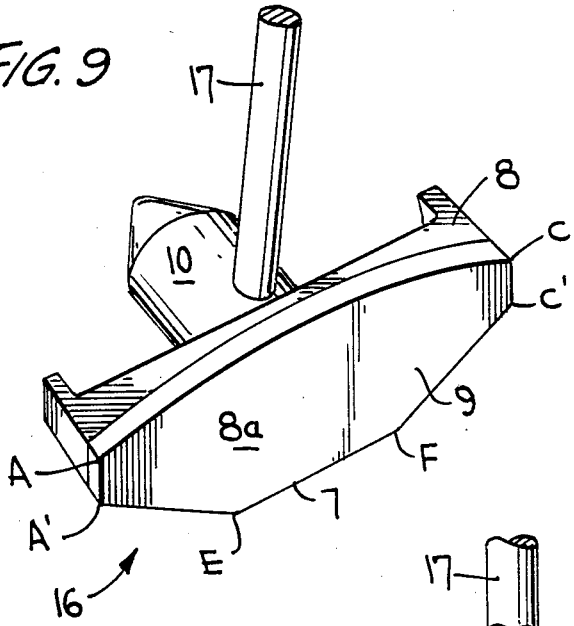
FIG. 9 illustrates a putter similar to the putter of FIG. 1 showing a flat portion on the face of the putter in modified form.

FIG. 9 discloses a further modification of the putter of FIG. 4 and, as seen, base 7 has a series of flat surfaces A'E, EF, and C'F. Point E is substantially in line with the club shaft when the shaft is in a vertical position. Top surface 12 of resilient pad 8*a* has a curvature between AC with the apex of the curve in line with shaft 17.

Figure 10:
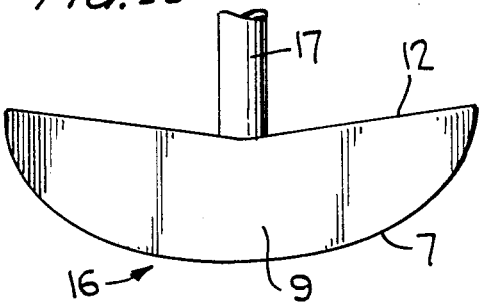
FIG. 10 is a front elevational view of another embodiment of the putter, the upper portion of the shaft being broken-away.
Figure 11:
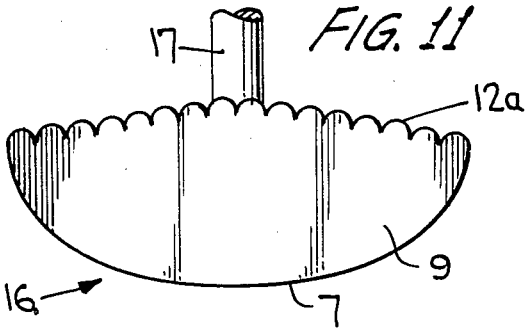
FIG. 11 is a front elevational view with the upper portion of the shaft thereof broken away in still another modified form.

FIGS. 10–21 illustrate still other embodiments of the putter constructed in accordance with the invention where, as before, the putter is generally identified by the numeral 15 and includes head 16 and shaft 17 extending upwardly from the head. In each of the embodiments shown, the head includes a blade-like front portion 8 which defines a striking face 9. Rearwardly of the blade-like front portion 8, the head 16 decreases in height and width in a smoothly, concavely curving manner to define a trailing portion 10 providing a generally T-shaped appearance. As shown in FIG. 10, the striking face 9 has a concave masking top 12. In FIG. 11 the top 12 of face 9 is convex and has scalloping 12*a*. In the putter illustrated at FIGS. 12–14, the top 12 of face 9 is concave; and in the embodiment of each of FIGS. 10, 11, and 12–14 the face 9 has a base 7 with a continuous curvature, i.e., there being no flat portion EF as in the embodiment of FIGS. 1, 4, and 9. Feet 20 on body 10 of the putter shown in FIGS. 12–14 are positioned so as to meet the surface of the ground when the putter is rotated 10°+ from the apex of the curvature of striking face 9. Accordingly, this putter, if desired, can be used in the conventional putting stance and swing.

The putter of FIG. 15 is substantially similar in design of the putter of FIGS. 12–14. However, face 9 has a concave top surface 12 and a substantially convex contoured base 7. Again feet 20 on body 10 permit the rotation of the putter at an angle of 10°+ to permit usage of the putter with a conventional stance.

The putter of FIG. 16, again being substantially similar to the putter of FIG. 12, includes on the base of face 9 feet 22 which provide a 10°+ angle from vertical when the middle and one of the outer feet meet the ground surface, permitting the putter to be used in the conventional manner. The feet 22 result in less drag when the putter is withdrawn after completing the forward stroke.

The putter of FIGS. 17 and 18 is similar to the putter of FIG. 10. However, the shaft has a crook 17*a*, advantageous when the putter is used with the conventional putting stance.

The putter of FIG. 19 is still a further embodiment having a contoured base 7 and a top with masking 12. This embodiment illustrates a putter whereby, when the shaft is in a substantially vertical position, the lowest point of the base 7 will not be directly under the shaft 17. However, because of the contoured top surface 12, when the putter is viewed from the top by the golfer, the appearance to the golfer is as if the lowest point of the base of the face is directly in line with the shaft.

Figure 20:
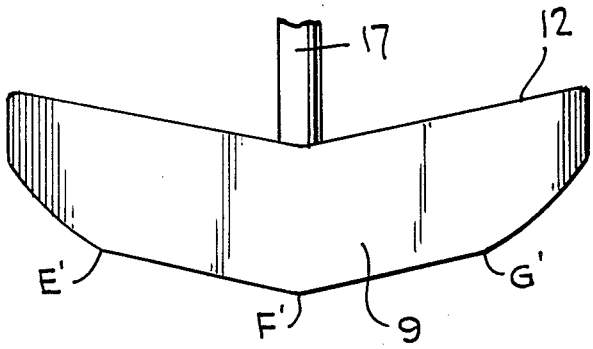
FIG. 20 is a front view of another modified form of putter in accordance with this invention, the upper portion of the shaft being broken-away.
Figure 21:
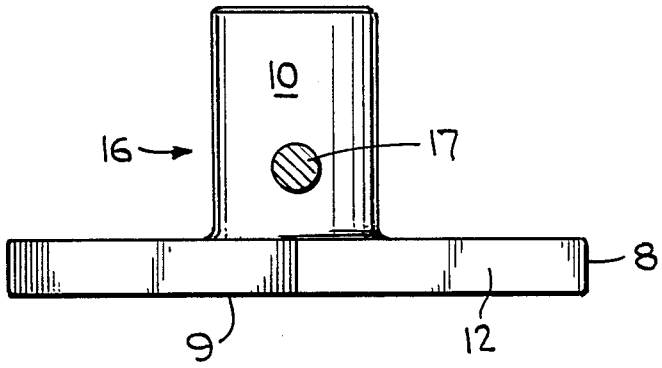
FIG. 21 is a top view of the putter of FIG. 20.

The putter of FIGS. 20 and 21 having flat portions E'F' and F'G' permits the putter to be used in the stance of FIGS. 5–8, and also in the conventional stance by both right- and left-handed golfers.

FIGS. 5–8 illustrate preferred stances for utilizing the putters herein defined. In accordance with the stance of FIG. 6, the golfer will stand in a slightly crouched position, slightly to one side of the ball, with the upper end of the shaft being engaged in the golfer's armpit or shoulder area. The respective arm will extend naturally along the shaft 17, with the respective hand gripping the shaft 17. The other hand and arm will be free, and preferably will be placed on the outside knee for better stability.

With the ball being positioned abreast of, or slightly forward of, the forward foot and slightly aside of both feet and with the head positioned to align the ball, the golfer may now maintain a line of sight in a vertical plane which contains the shaft 17, the ball, and the cup (not shown). In other words, the line of sight will be in the plane of the intended swing of the putter 15. Further, in swinging the putter the arm action will be a normal free swinging of the arm in a vertical plane, with the putter 15 being fully stabilized by the engagement of the free end of the shaft 17 in the armpit or shoulder area. Effectively, the putter is an extension of the arm. Thus, it is possible with putter 15 in the stance of FIG. 6 to obtain maximum control over the swing of the putter; to effect the swinging of the putter in a natural arm movement, and at the same time to maintain the head of the putter, the ball, and the cup in a single line of sight.

Figure 5:
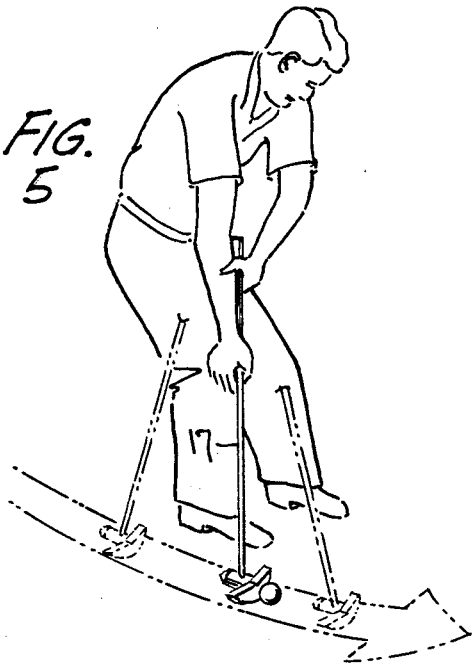
FIG. 5 is a schematic perspective view showing one preferred method of utilizing the putter of FIG. 1.

FIG. 5 illustrates another preferred stance for utilizing the putter of this invention. In accordance with this stance, the golfer will stand in a slightly crouched position with only a slight bending of the knees, slightly to one side of the ball. The shaft of the putter is gripped about midway in one hand, with the free end of the shaft extending along the golfer's forearm, terminating at approximately the inner elbow. The golfer's free hand is used to simultaneously grip the putter shaft and the forearm, providing a stabilizing action. As illustrated, the arm will extend naturally along the shaft 17 with the hand gripping the shaft 17 so as to permit a natural free movement. With the golf ball being positioned abreast of the forward foot and slightly aside of both feet, and with the head positioned to align the ball, the golfer may now maintain a line of sight in a vertical plane which contains the shaft 17, the ball, and the cup (not shown). As in the stance shown in FIG. 6, the putter is effectively an extension of the golfer's arm.

Figure 8:
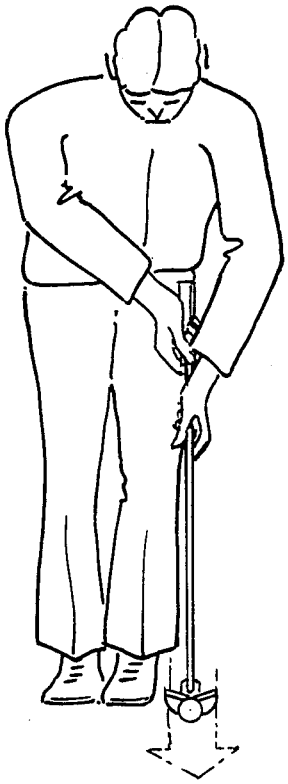
FIG. 8 is a perspective view of still another modification of the method of utilizing the putter as illustrated in FIG. 5.
Figure 7:
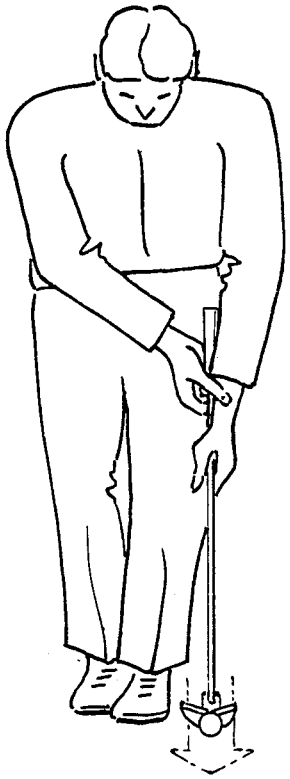
FIG. 7 is a schematic perspective view illustrating a modification of the method of utilizing the putter as shown in FIG. 5.

FIGS. 7 and 8 are modifications of the stance shown in FIG. 5. In the embodiment of FIG. 7, the shaft is not held firmly by the golfer. Rather, the golfer engages the club gripping arm with his thumb and forefingers substantially at the wrist with the shaft of the club maintained in loose contact with the forearm and the free hand. The wrist of the gripping hand is capable of free movement. The stance provides guiding and stabilizing control of the putter as it strikes the golf ball and, thus, permits accuracy in direction and distance of ball travel.

In the modification shown in FIG. 8, the free hand loosely engages the end of the club shaft, again providing for the free movement of the wrist. The wrist movement permits control of the putter as the putter face strikes the golf ball, providing accuracy in direction and distance of ball travel.

As will be apparent in utilizing any of the stances shown in FIGS. 5–8, the putter can be advantageously modified by shortening or lengthening the shaft depending upon the golfer and the stance used. A short putter shaft will permit the shaft to be gripped at about its mid-length with the free hand at the end of the shaft for use as a guiding or stabilizing control. A long shaft can effectively cause the shaft to be an extension of the golfer's arm and/or permit the end of the shaft to engage, for example, the golfer's armpit. These are modifications which will be apparent to one skilled in the art.

Various features are critical or important in the putter of the present invention to provide its most effective use in accordance with the stances of FIGS. 5–8. It is critical that the overall width AC of the striking face of the putter is greater than the height BD of the face of the putter. Further, it is essential that the putter face have a minimum width. In the game of golf psychological factors play an important role, this being particularly true in the putting part of the game. By having the width of the face of the putter substantially greater than the diameter of the golf ball, the golfer has greater confidence in making a smooth, controlled stroking or swinging action. Specifically, if the striking face of the putter is too narrow, it is difficult to stroke the putter in a straight line as one tends to guide the putter to the ball rather than to the hole. By having the width of the putter greater than the overall height, the sense of control of the putter is increased. Accordingly, the putter preferably will have a width of at least three inches, i.e., about twice the diameter of a golf ball; with a height of approximately one inch. The preferred range is from about three inches to five inches in width, and a height of three-quarters of an inch to two and one-half inches. A width of greater than about six inches tends to force the golfer to move the ball sideways away from his adjacent foot to avoid hitting his foot with the heel of the putter face when making a stroke.

The visual impression which is given to the golfer when he views the putter head from the top is of critical importance. It is essential that the top surface of the putter is designed or masked to give the golfer the impression that, when viewed from the top as the putter would be viewed by the golfer in the stances illustrated in FIGS. 5–8, a lowermost, or the lowermost surface of the putter is directly below and in line with the putter shaft when the putter is in the vertical position as it is used in the stances shown in FIGS. 5–8. The masking of the putter face is accomplished by shaping the top of the putter face so as to provide a substantially symmetrical appearance. Preferred shapes are concave lines, as shown in FIGS. 1–3, 4, 10, 12–14, and 15–21; or convex lines as shown in FIG. 11. Alternatively, the masking can be by a continuous curvature as in FIG. 9 with the apex of the curvature substantially in line with the shaft. Scalloping as shown in FIG. 11 is also effective. The essential feature is that the head, when viewed from the top, gives the golfer the appearance that a lowermost point of the base of the face is directly in line with the shaft, providing confidence to the golfer that he will have clean contact with the ball upon swinging, and confidence that he will not dig into the putting surface with the base of the putter.

A further important feature of the putter is that the putter head have the proper weight and distribution of weight to provide balance. Accordingly, the preferred embodiments are putters as shown in the drawing wherein the putter includes a body portion in order that together with the blade-like face the putter is substantially T-shaped. It is preferable that the length of the body of the putter be less than the width of the putter face. Preferably the body will not be greater than two-thirds of the width of the face; i.e., if the putter has a width of four inches, the body length will be at most three inches. Proper weight and weight distribution is effectively controlled by shaping the body portion, as for example at 26 of FIG. 1, or 28 of FIGS. 13, 14, and 17, or by hollowing as at 30 of FIGS. 12–19.

A further important feature is the placement of the shaft into the head in order to provide proper axial balance so as not to have a turning tendency in the hands of the golfer when the putter is being swung. Preferably, therefore, the shaft placement is rearward of the face of the putter and in the body portion of the head.

A further important characteristic of the putter of the present invention is the inclusion of a pad on the face of the putter to provide controlled resiliency. The pad preferably is from about 1/16th of an inch to ¾ of an inch in thickness and is a polymeric elastomer. The face having controlled resiliency provides excellent feel to the golfer when stroking the ball in that it keeps the ball on the face of the putter, or gives the feeling of keeping the ball on the face of the putter a fraction of a second longer. It has been found that preferred elastomers are the polyurethane rubbers such as the Adiprenes marketed by the DuPont Corporation. Preferably the elastomer selected will have a hardness ranging between 60 durometer A and 75 durometer D. Such elastomers provide excellent feel, but yet are resistant to the effects of normal usage of the putter. As shown at FIG. 9, the resilient pad 8*a* can also be used to effectively mask the top 12 of the putter face.

The various features noted hereinbefore, although each is not critical to developing a putter in accordance with the present invention, when used in proper combination and within the stated ranges, provides a putter having in its totality the characteristics desirable in a putter particularly for use in the stances shown in FIGS. 5–8. Putters having the aforesaid characteristics are also effective and have good feel when employed with a conventional stance and swing.

"Masking" is used herein to define any means of providing an appearance of symmetry to the face of the putter having a contoured base when the putter is viewed from its top, irrespective of the shape of the base of the putter.

Various modifications can be made based on the aforesaid without departing from the scope of the present invention. Such modifications being within the ability of one skilled in the art are to be embraced herein.

It is claimed:

1. A golf putter comprising a head and a single substantially straight shaft connected to said head only at a single location on said head, said head including a face having a width greater than its height, said face having a generally convex base; a top surface which is generally concave or convex, and said base and top surface being joined by two ends; said single shaft connected to said head generally midway of the width thereof and at an angle of at least ten degrees to a vertical line extending through the center of a horizontal line extending across said face of said putter, said top surface of the face overlying said base and extending substantially the full width of the face, said top surface and said two ends, together with said single shaft, defining masking means whereby the head, when the shaft is in a substantially vertical position and viewed from the top of the putter, gives a visual impression of having the lowest point of the base of the face of the putter substantially in axial alignment with said shaft.

2. A putter of claim 1 wherein the generally convex base includes a flat surface and a curvature at each end of said flat surface.

3. The putter of claim 2 wherein said head includes a body portion rearward of said face, said face and said body portion giving said head a T-shape, said width of said face being greater than the length of said body portion, said shaft extending from said body portion.

4. The putter of claim 1 wherein the top surface of said face has a substantially symmetrical concave surface.

5. The putter of claim 1 wherein the top surface of said face has a substantially symmetrical convex surface.

6. The putter of claim 1 wherein the top surface of said face has a substantially symmetrically curved surface.

7. The putter of claim 1 wherein said face includes a pad of controlled resiliency.

8. The putter of claim 7 wherein said pad is a polyurethane rubber having a hardness between 60 durometer A and 75 durometer D.

9. The putter of claim 1 wherein the contoured base includes a plurality of flat surfaces.

10. A golf putter comprising a head and a single substantially straight shaft connected to said head only at a single location on said head, said head including a face having a width at the top surface thereof, which is generally concave or convex, extending A through B through C and a height B through D with the base of the face extending A through D through C having a contoured shape, with said contoured shape being masked by said top surface of said face, the distance between A and B and B and C being substantially equal and the distance between A and C being greater than the distance between B and D; said single shaft positioned in said head at an angle to a line extending through B and D wherein D is at the midpoint between A and C, said putter being constructed and arranged whereby the head, when said single shaft is in a substantially vertical position, has the appearance when viewed from the top of the putter of having a lowest point of said contoured base of the face of the putter being substantially in axial alignment with said shaft due to a masking of said contoured base by said generally concave or convex top surface of said face.

* * * * *